US008467668B2

(12) United States Patent
Searle et al.

(10) Patent No.: US 8,467,668 B2
(45) Date of Patent: Jun. 18, 2013

(54) INFRARED ROOM HEATER SYSTEM

(75) Inventors: Bruce R. Searle, Akron, OH (US); Alexander Anderson, McKenna, WA (US)

(73) Assignee: Acepower Logistics, Inc., Taipei (TW)

( * ) Notice: Subject to any disclaimer, the term of this patent is extended or adjusted under 35 U.S.C. 154(b) by 1129 days.

(21) Appl. No.: 12/311,059

(22) PCT Filed: Oct. 29, 2007

(86) PCT No.: PCT/US2007/022846

§ 371 (c)(1), (2), (4) Date: Mar. 16, 2009

(87) PCT Pub. No.: WO2008/057321

PCT Pub. Date: May 15, 2008

(65) Prior Publication Data

US 2009/0285567 A1 Nov. 19, 2009

Related U.S. Application Data

(60) Provisional application No. 60/879,084, filed on Jan. 8, 2007, provisional application No. 60/855,661, filed on Nov. 1, 2006.

(51) Int. Cl.
*F24D 19/02* (2006.01)
*F24H 9/06* (2006.01)

(52) U.S. Cl.
USPC ..... 392/371; 392/352; 392/356; 392/365; 392/368; 392/370; 392/374; 392/375; 392/379; 392/407; 392/416; 392/422; 392/423; 392/424; 392/430; 392/435; 392/436; 392/437; 219/210; 219/213; 219/494; 219/497; 219/501; 219/507; 219/481; 219/505; 219/512; 219/530; 219/532; 219/540; 219/545; 219/549

(58) Field of Classification Search
USPC ..... 392/352, 356, 365, 368, 370, 371, 392/374, 375, 379, 407, 416, 422, 423, 424, 392/430, 435, 436–437; 219/210, 213, 494, 219/497, 501, 507, 481, 505, 512, 530, 532, 219/540, 545, 549; 126/99 R–117; 165/168–171, 53, 75
See application file for complete search history.

(56) References Cited

U.S. PATENT DOCUMENTS 1,227,324 A * 5/1917 Russell ..... 392/476
2,492,379 A * 12/1949 Cranston, Jr. ..... 392/430

(Continued)

FOREIGN PATENT DOCUMENTS

GB 2121159 12/1983

*Primary Examiner* — Tu B Hoang
*Assistant Examiner* — Brett Spurlock
(74) *Attorney, Agent, or Firm* — Brian J. Coyne

(57) ABSTRACT

An infrared, room heater system for installation in a wall or on a floor. An electric fan assembly draws room air into a housing, then through three parallel, air transit channels where the air is heated by infrared radiation within and about a heat exchanger assembly, and then back out into the room. One or more ceramic heating elements attached to a first copper plate emit infrared radiation when electrically energized. The first copper plate lies adjacent to, but spaced away from, a second copper plate such that radiation emitted from the heating elements reflects back and forth between the plates. Room air passed between the copper plates is heated by heat radiation concentrated between the plates, thereby achieving both energy and space efficiency.

33 Claims, 14 Drawing Sheets

U.S. PATENT DOCUMENTS 2,606,992 A * 8/1952 MacDonald ..... 392/371
2,727,978 A * 12/1955 Beckett et al. ..... 392/376
2,820,880 A * 1/1958 Huntsinger et al. ..... 392/363
2,863,978 A * 12/1958 Young ..... 392/355
2,995,645 A * 8/1961 Rankin, Jr. ..... 392/435
3,023,297 A * 2/1962 Abel ..... 392/430
3,059,090 A * 10/1962 Waters ..... 392/376
3,120,225 A * 2/1964 Stark et al. ..... 126/110 AA
3,160,482 A * 12/1964 Foote ..... 34/665
3,176,117 A * 3/1965 Knoll et al. ..... 392/360
3,179,788 A * 4/1965 Uhlig ..... 392/359
3,189,727 A * 6/1965 Jepson et al. ..... 392/376
3,223,828 A * 12/1965 Mast ..... 392/364
3,269,382 A * 8/1966 Ronan et al. ..... 126/101
3,277,274 A * 10/1966 Raabe ..... 392/371
3,365,811 A * 1/1968 Djenner ..... 34/97
3,408,479 A * 10/1968 Welch, Sr. ..... 392/354
3,564,201 A * 2/1971 Jones et al. ..... 392/372
3,590,218 A * 6/1971 Steiner ..... 392/363
3,612,824 A * 10/1971 Berryman et al. ..... 392/383
3,632,981 A * 1/1972 Gasparaitis ..... 392/376
3,654,913 A * 4/1972 Derringer et al. ..... 126/512
3,767,894 A * 10/1973 Berger ..... 219/472
3,767,895 A * 10/1973 Needham ..... 392/438
3,775,590 A * 11/1973 Gartner ..... 392/367
3,777,117 A * 12/1973 Othmer ..... 392/469
3,829,656 A * 8/1974 Temrin ..... 392/370
4,596,236 A * 6/1986 Eide ..... 219/621
4,629,864 A * 12/1986 Wilson ..... 392/385
4,638,943 A * 1/1987 Casier et al. ..... 237/7
4,682,009 A * 7/1987 Meiser et al. ..... 392/375
4,729,365 A * 3/1988 Mutchler ..... 126/110 B
4,784,110 A * 11/1988 Skafte et al. ..... 126/110 AA
5,056,501 A * 10/1991 Ida ..... 126/110 B
5,201,651 A * 4/1993 Niksic et al. ..... 431/12
5,243,682 A * 9/1993 Eberts ..... 392/370
5,568,586 A * 10/1996 Junkel ..... 392/376
5,655,055 A * 8/1997 Goldstein et al. ..... 392/367
5,692,291 A * 12/1997 Deevi et al. ..... 29/611
5,761,377 A * 6/1998 Wolfe et al. ..... 392/376
5,802,249 A * 9/1998 Kurz ..... 392/347
5,909,535 A * 6/1999 Curwick et al. ..... 392/476
6,609,664 B1 * 8/2003 Tamhane ..... 237/70
7,003,216 B2 * 2/2006 Wagner ..... 392/405
7,004,159 B1 * 2/2006 Carpenter et al. ..... 126/19 R
7,195,010 B2 * 3/2007 Kuroda et al. ..... 126/116 A
2003/0010771 A1 * 1/2003 Stanzel ..... 219/494
2004/0099655 A1 * 5/2004 Mariotti ..... 219/490
2005/0082277 A1 * 4/2005 Jones et al. ..... 219/494
2005/0279343 A1 * 12/2005 MacPherson ..... 126/91 A
2006/0110141 A1 5/2006 Burkett et al.
2006/0199516 A1 9/2006 Kim et al.

* cited by examiner

INFRARED ROOM HEATER SYSTEM

CROSS REFERENCE TO RELATED APPLICATIONS

This application claims the benefit of a provisional patent applications by the same applicants for a first embodiment of the same invention filed on Nov. 1, 2006, application No. 60/855,661 and a provisional application by the same applicants for a second embodiment of the same invention filed on Jan. 8, 2007, application No. 60/879,084.

STATEMENT REGARDING GOVERNMENT SPONSORED RESEARCH

None.

BACKGROUND OF THE INVENTION

1. Field of the Invention

This invention relates generally to energy efficient, safe, high tech, in-the-wall building and room heaters that are intended to promote personal comfort and health, and particularly to such heaters that are electrically powered and emit infrared radiation. In a first embodiment, the invention can be unobtrusively installed within the confines of a standard interior wall space that is at least 3½ inches (8.9 cm) deep and between two 16 inch (40.6 cm) on center (or more) wall studs. In a second, alternative embodiment, the invention can be placed upon the floor of a room and electrically powered from an a.c. wall or floor outlet. Preferably, the second embodiment is also made portable by resting on caster wheels.

2. Description of Related Art

In-the-wall room heaters have mainly comprised apparatus for delivering centrally heated air ducted from an electrical or gas central heater, of an inefficient nature, located outside the building or in a cellar, furnace room or garage. Heating and maintenance costs for such heaters have run unacceptably high. Other in-the-wall heaters have comprised apparatus entirely confined to a single room that is to be heated, but have depended upon relatively low temperature heating elements and high volume fans to prevent fire hazard. Heaters mountable upon an interior wall surface of a room (on-the-wall heaters) have also incorporated relatively low temperature heating elements and high volume fans. Each of these kinds of heaters is relatively noisy, inefficient, expensive to operate and, in the case of propane and kerosene wall-mounted heaters, also consume room oxygen to the potential detriment of the health of room occupants. Portable room heaters have been constructed similarly to the above-mentioned stationary room heaters and have also been relatively inefficient to run, sometimes have been fire prone, and consume room oxygen.

SUMMARY OF THE INVENTION

Accordingly, there remains a need for a room heater that overcomes the above-described disadvantages of the previously known room heaters.

It is, therefore, and object of this invention to provide an electrically-powered room heater that, in a first embodiment, can be mounted entirely within the interior wall space of a room of a building and emit infrared radiation to heat the air in the room, and, in a second embodiment, to provide such a heater than can be placed upon, and easily be moved across the surface of, a floor of a room.

It is a further object of this invention to provide such a heater that efficiently converts electrical energy consumed by the heater into heat energy within the room, thereby making the heater relatively inexpensive to operate.

It is still a further object of this invention to provide such a heater that will not consume room oxygen or room air moisture.

It is another object of this invention to provide such a heater that includes one or more electric fans to draw air in from a room and expel heated air back into the room, but nevertheless operates quietly.

It is still another object of this invention to provide such a heater that includes effective heat shielding to prevent excessive build up of heat in any wall into which it may be installed, thereby avoiding a fire hazard.

It is a further object of this invention to provide for the user easy access, maintenance and cleaning of internal components thereof, which components include a removable heat exchanger assembly and a mesh, electrostatic air filter.

These and other objects of the invention will become apparent from the figures and detailed description of the invention, and are accomplished through first and second embodiments of the invention, which embodiments principally have in common that they employ the same method to heat by infrared radiation room air drawn into the interior space of a heater system housing, thereafter expelling heated air back out into the room.

According to the method of the invention, air is drawn into a substantially closed interior space of a heater system that includes a housing. The housing has first and second, spaced apart sidewalls and contains means for electrically powering the system, and a heat exchanger assembly that emits infrared radiation whenever sufficient electric current from the means for electrically powering the system passes through a resistive conductor encased within one or more ceramic heating elements attached to a first copper plate. Attached to each of the sidewalls are first heat insulating means to impede flow of heat from the heat exchanger into the housing sidewalls. Air within the housing interior is forced through parallel first, second and third air transit channels. The first air transit channel is defined by space between a first copper plate and the first insulating means. A second copper plate is mounted to the heat exchanger assembly adjacent to, but spaced apart from, a first insulating means attached to the second sidewall, and the second air transit channel is defined by the space between the second copper plate and said first insulating means. A third air transit channel is defined by the space between the first and second copper plate. Inlet air traversing the first and second air transit channels has the beneficial effect of cooling the housing sidewalls while at the same time absorbing heat directly from the sidewalls and indirectly from the first and second copper plates. The inlet air traversing the third air transit channel is heated directly by infrared radiation emitted from the one or more ceramic heating elements and from the first and second copper plates. Each ceramic heating element encases a resistive conductor, which is preferably configured in a sinuous path within the body of the ceramic heating element. In the below-described embodiments of the system, electric current passes through a resistive conductor of the one or more ceramic heating elements and a fan assembly draws room air into the housing interior and forces the air through the heat exchanger assembly and back out into the room as heated air whenever the temperature of the room falls below a user-selected temperature setting in a thermostat. In the case of the first embodiment, the thermostat is preferably mounted on a wall of the room that is to be heated; in the case of the second embodiment, the thermostat is mounted on the room heater itself.

Means for electrically powering the system include a first d.c. power circuit that energizes a first electric fan within the fan assembly and energizes a solid state relay. A low temperature sensor limit switch attached to the heat exchanger assembly is wired in series with the first electric fan; this switch is open when the sensed temperature of the heat exchanger assembly is below 36° C. and closes, turning on the first fan, when the temperature rises above that level. When energized, the relay provides a conductive path for 120 volt a.c. power to be applied to a second d.c. circuit and to the one or more ceramic heater elements. The second d.c. circuit powers two additional electric fans within the fan assembly. A high temperature sensor limit switch wired in series with the heater elements is attached to the heat exchanger and opens whenever the temperature of the heat exchanger exceeds 76° C., thereby de-energizing the heater elements.

The housing for the first embodiment is preferably configured for installing the system within a standard room wall of depth 3½ inches (8.9 cm) and between wall studs spaced 16 or more inches (40.6 cm) on center apart, with an air inlet grate attached to the housing and disposed above the heat exchanger assembly, and with an air outlet grate attached to the housing and disposed below the heat exchanger assembly. The means for electrically powering the system is disposed within a lower interior space of the housing and is heat insulated from the rest of the interior space of the housing by an isolation wall. Interposed between the air inlet grate and the air outlet grate is a front panel that attaches to front edges of the housing sidewalls. By removing the front panel and the air outlet grate, the entire heat exchanger assembly can be removed from the system for cleaning and/or for replacement of ceramic heating elements within the assembly.

The housing for the second embodiment, intended for placement on the floor of a room that is to be heated, is substantially closed except for an air inlet cutout on a rear wall of the housing, and an air outlet cutout, and a control panel cutout on a front wall of the housing. Air inlet and outlet grates are mounted over the air inlet and air outlet cutouts, respectively, and a control box is installed within the control panel cutout. A front wall of the housing also has a heat exchanger assembly cutout, which permits the assembly to be slid in and out of the housing between horizontal upper and lower tracks. The heat exchanger assembly is disposed for horizontal flow of air from the rear interior of the housing through the heat exchanger assembly and toward the front interior of the housing, and thence back out into the room through the air outlet grate. A portion of the room air that enters the system 10' through the air inlet grate, however, first flows forward under a lower surface of the lower track, then rearward between an upper surface of the lower track and the heat exchanger assembly, thence is drawn through the fan assembly and forced through the heat exchanger assembly. Similarly, another portion of the room air that enters the system 10' through the air inlet grate first flows forward over an upper surface of the upper track, then rearward between the upper track and the heat exchanger assembly, thence is drawn through the fan assembly and forced through the heat exchanger assembly. In this manner, the upper and lower tracks are air cooled, as is the housing and the means for electrically powering the system 10' that is disposed within the housing above the upper track. Preferably, the housing is supported by caster wheels that permit the system to be wheeled about a room floor surface.

The operating temperature within the heat exchanger assemblies of the first and second embodiments is about 243° C., which means that both embodiments are germicidal and fungicidal. Both embodiments produce about 35 percent greater heat output compared to conventional infrared quartz heater technology for the same electrical power input.

BRIEF DESCRIPTION OF THE DRAWINGS

Similar numerals denote similar components throughout the several views.

DESCRIPTION OF THE PREFERRED EMBODIMENT

Figure 1:
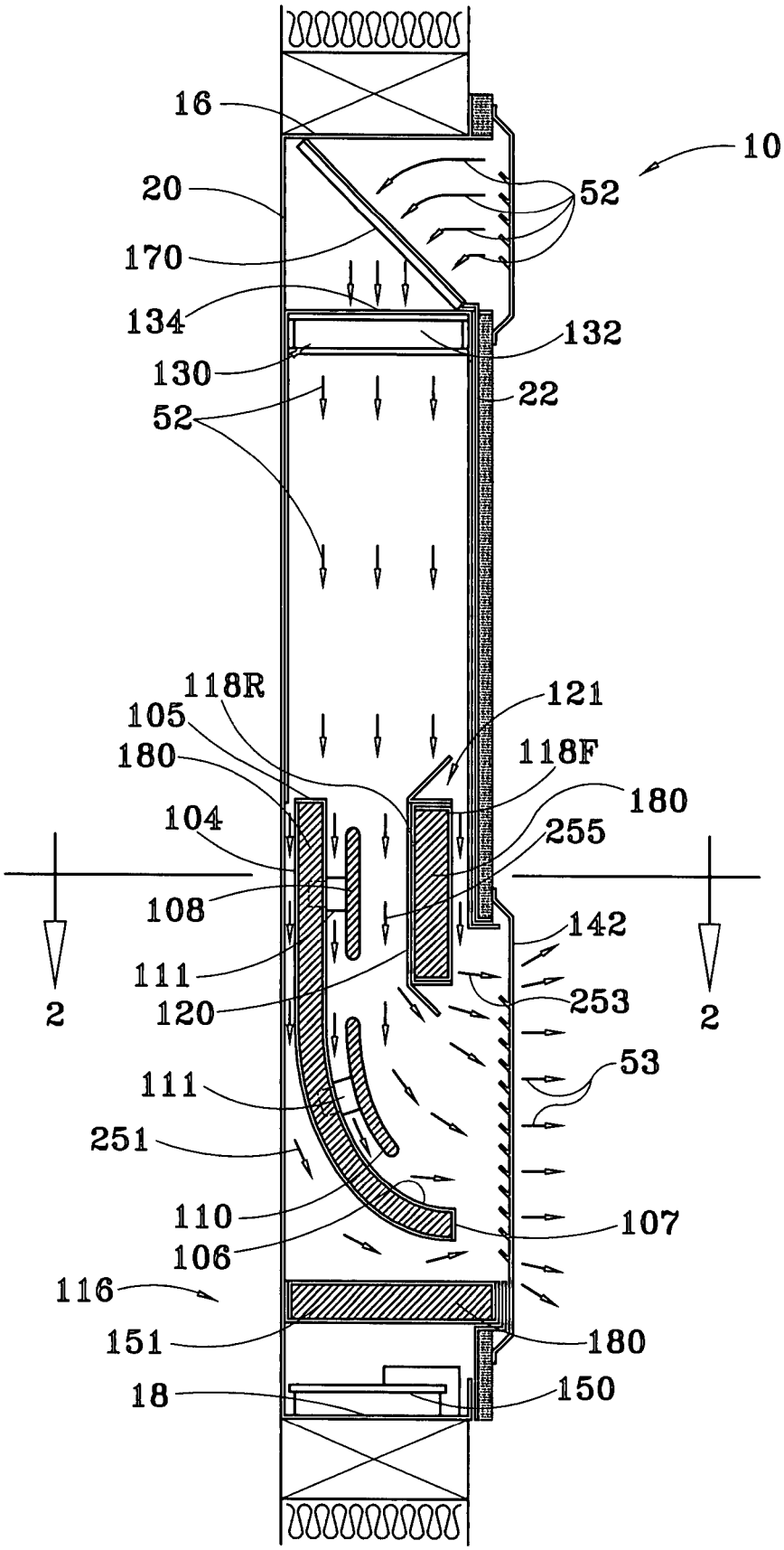
FIG. 1 is a vertical cross-sectional view of a first embodiment of an in-the-wall, infrared heater system according to the present invention together with a vertical cross-sectional view of a surrounding room wall into which the system has been installed.
Figure 2:
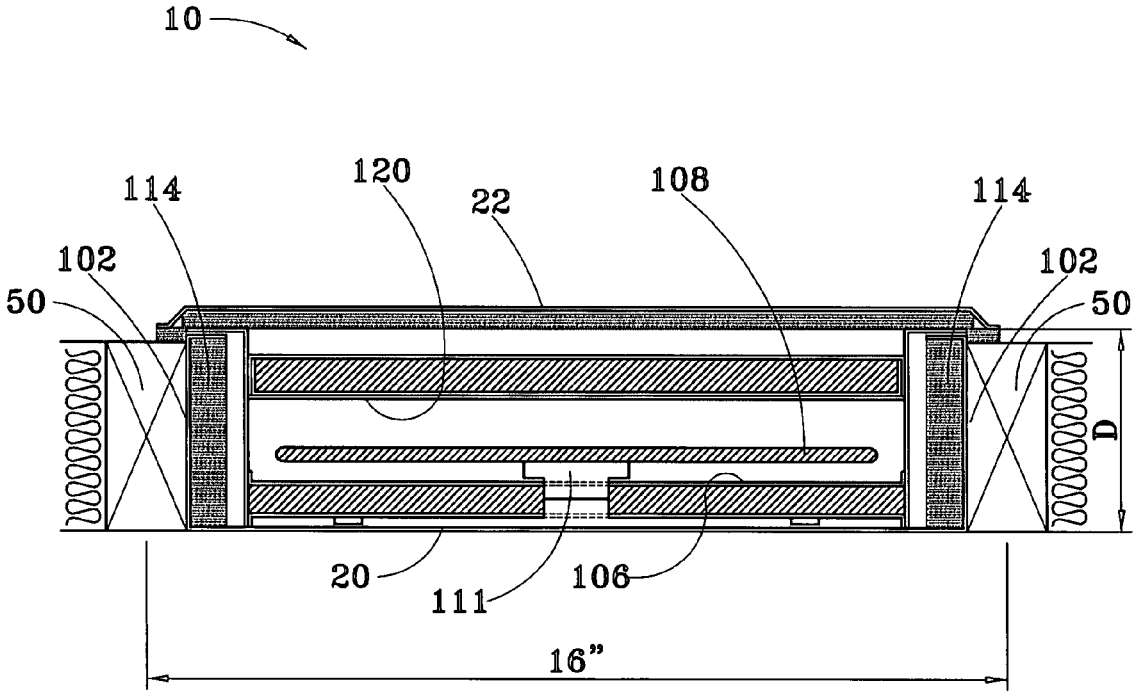
FIG. 2 is a horizontal cross-sectional view thereof taken along line 2-2 of FIG. 1.
Figure 3:
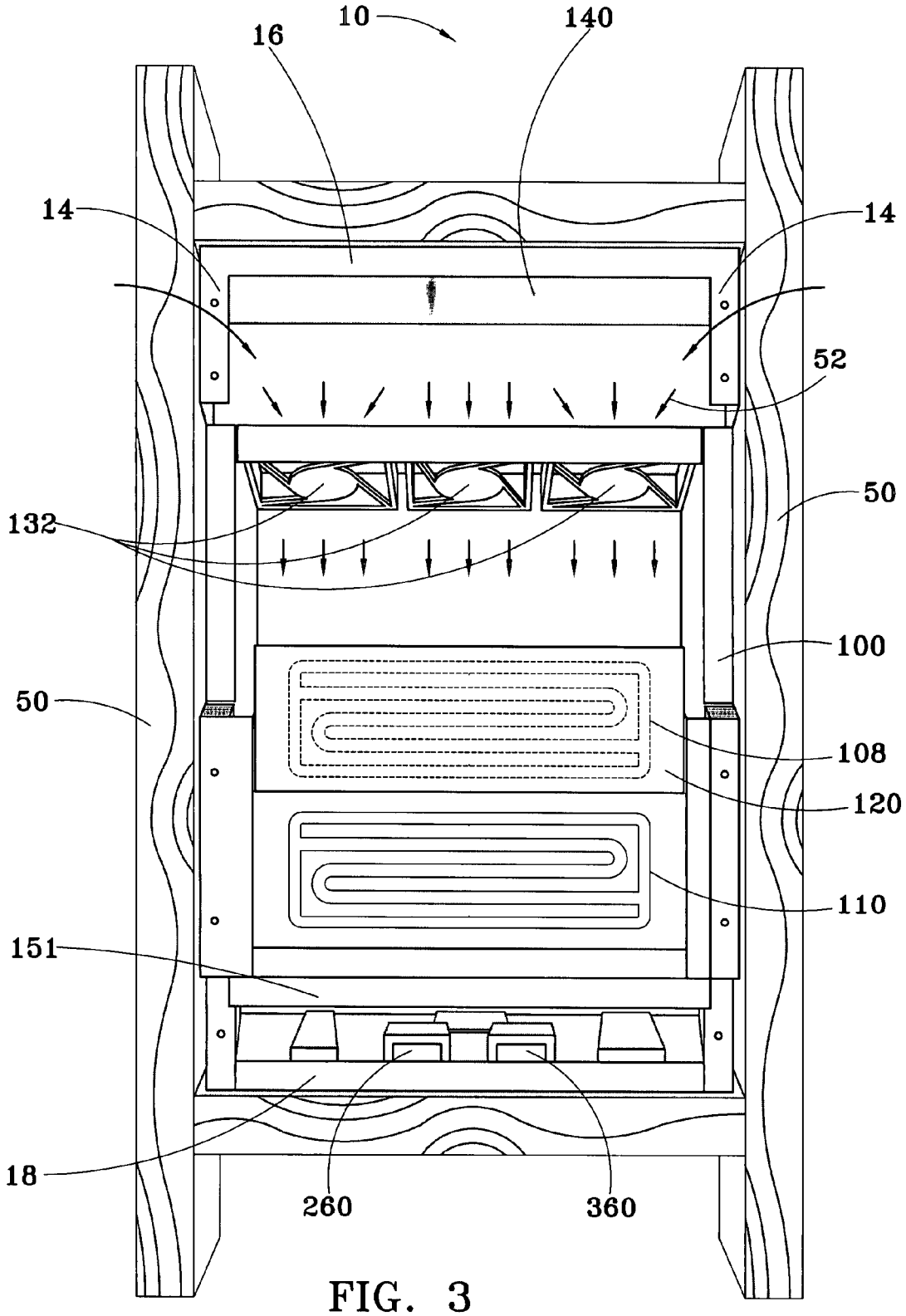
FIG. 3 is a front elevational view thereof.

Referring to FIGS. 1 and 2, a preferred embodiment of an electrically-powered, infrared heater system of the present invention, denoted generally by the numeral 10, is depicted in vertical and horizontal cross-sectional views, respectively, installed between wall studs 50 spaced 16 inches (40.6 cm) apart within a standard interior building wall having depth D of 3½ inches (8.9 cm). As denoted by the arrows 52, when the system is in an operating heating mode, room air is drawn into the interior of the system 10 through a child-proof, air inlet grate 140, thence through an electrostatic mesh filter 170 by rotating blades of electric fans 132, and then forced downward through a removable heat exchanger assembly 100 where the air is heated and from whence the heated air, denoted by arrows 53, exits through a child-proof, air outlet grate 142 back into the room.

Figure 6:
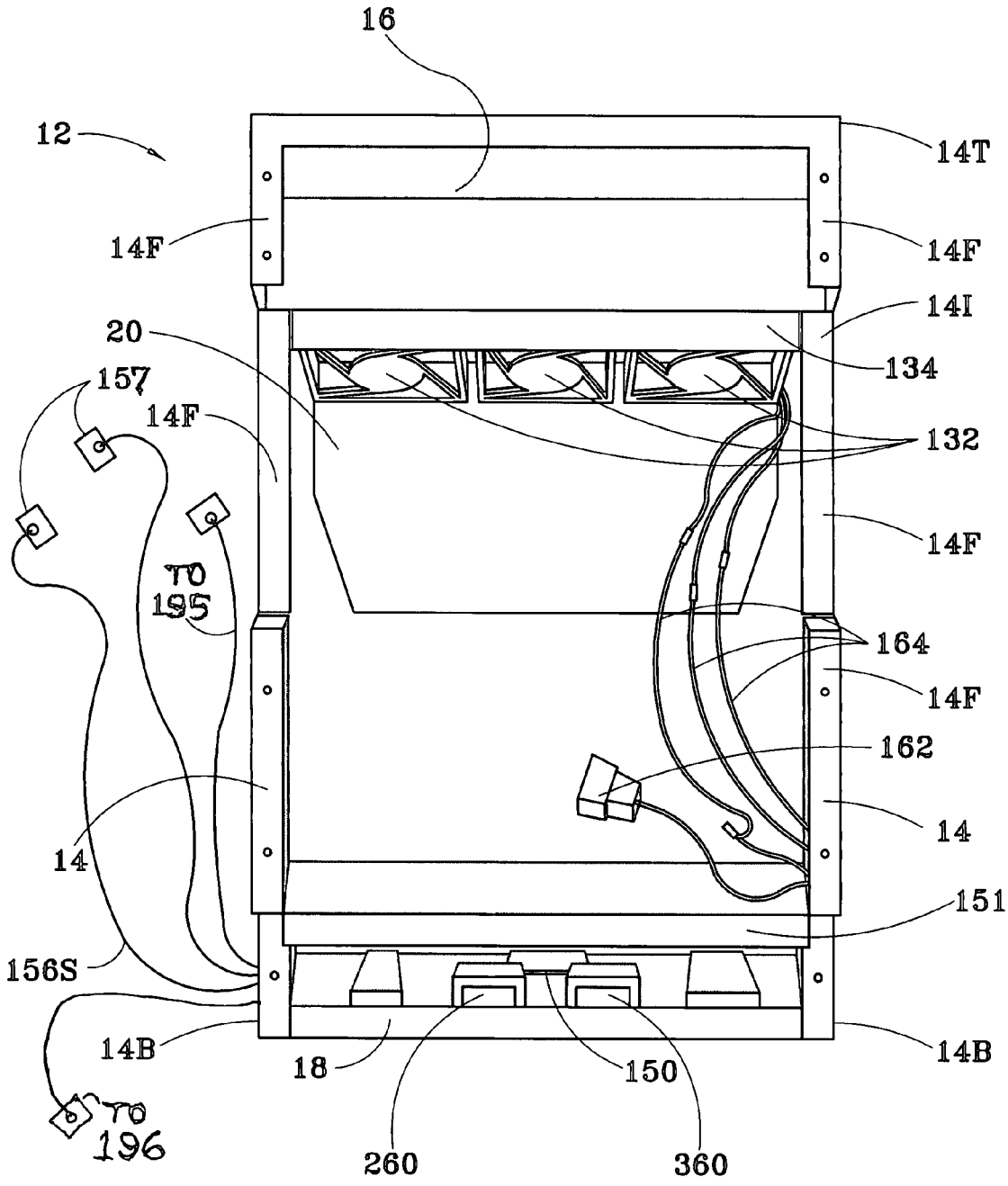
FIG. 6 is front perspective view of the system housing after removal of all component parts of the system except the fans and the electrical power supply.
Figure 7:
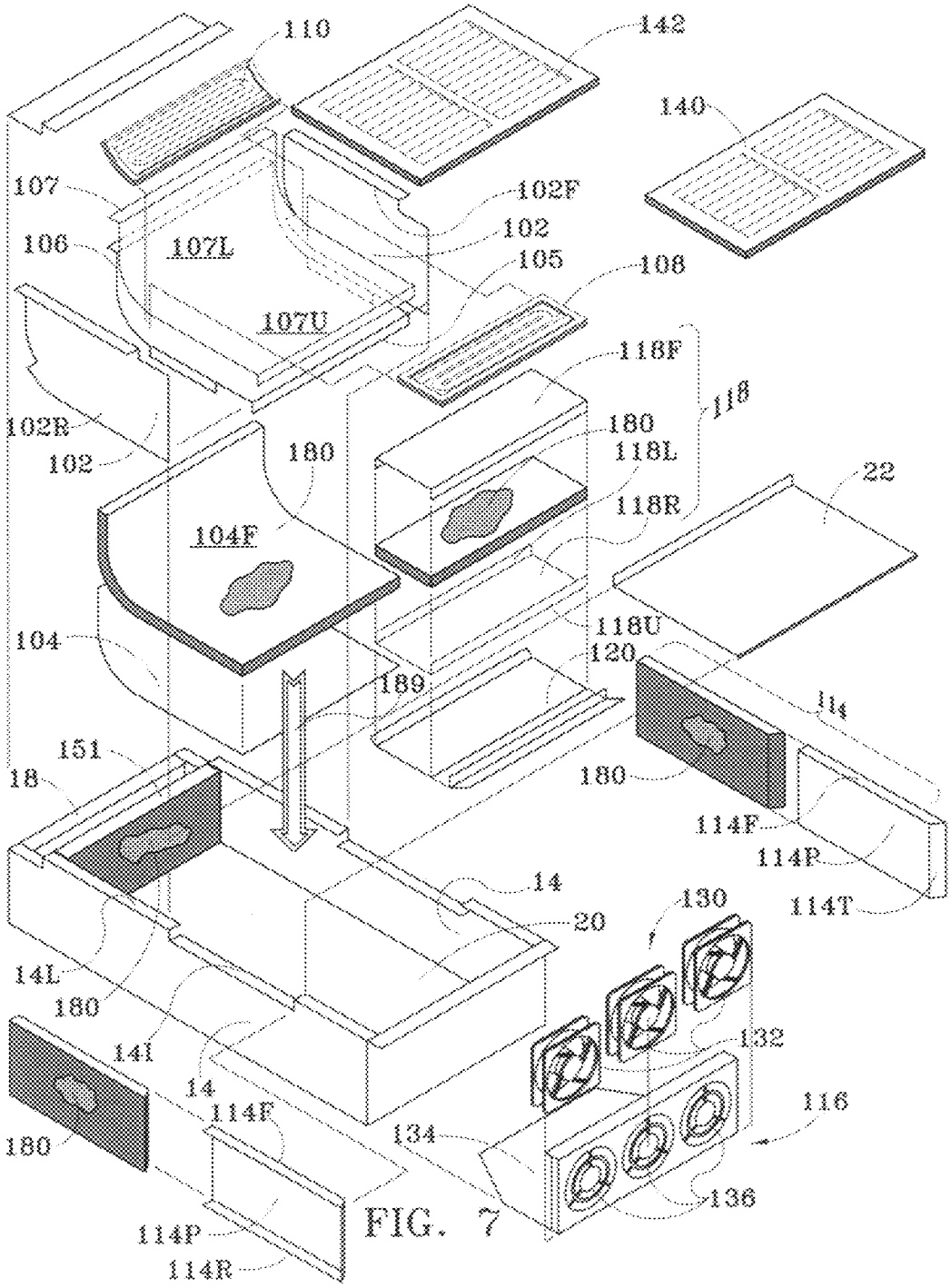
FIG. 7 is a front, perspective, exploded view of a lower portion of the system with some components removed for clarity, depicting the housing, heat exchanger assembly, and fan assembly.

As may best be seen in FIG. 6, the system 10 includes a housing, denoted generally by the numeral 12, having a pair of laterally spaced-apart sidewalls 14 that each extend vertically from a bottom end 14B to a top end 14T, a laterally disposed bottom cross member 18 and a laterally disposed top cross member 16 that join the sidewall bottom and top ends 14B, 14T, respectively, and a laterally disposed power supply isolation wall 151 that joins the sidewalls 14 intermediate the bottom cross member 18 and the top cross member 16. The sidewalls 14, isolation wall 151, and top and bottom cross members 16, 18 each have rear edges and opposite front edges. A flat, housing rear panel 20 extends from the top cross member 16 to the bottom cross member 18 to which the rear edges of the sidewalls 14R, isolation wall 151R and bottom and top cross members 18R, 16R are attached, thereby defining an interior space of the housing 12 that is open at the front thereof. Referring to FIGS. 6 and 7, each of the front edges of the sidewalls 14 is divided into an upper edge portion 14U, an intermediate edge portion 14I, and a lower edge portion 14L, and each edge portion includes a flange 14F. The upper edge portion 14U and the lower edge portion 14L are aligned on a straight line, but the intermediate edge portion 14I is recessed to provide relief space for attachment of a removable front panel 22 to the intermediate edge portion 14I. All the flanges 14F are apertured for receiving machine screws that attach the upper grate to the upper edge portion 14U, a front panel 22 to the intermediate edge portion 14I, and a lower grate 142 to the lower edge portion 14L.

The system further includes a fan assembly 130 and a heat exchanger assembly 100 disposed below the fan assembly for heating room air as it flows downward through a lower, interior portion of the system 10. As may best be seen in FIGS. 6 and 7, the fan assembly 100 includes a fan mounting bracket 134 disposed laterally between upper ends of the recessed, intermediate edge portions 14I and suspended from the housing sidewalls 14. The fan assembly 100 further includes three, laterally spaced-apart, electric fans 132 mounted within apertures 136 in the fan mounting bracket 100. Each of the fans 132 has a fan blade that rotates about a vertical axis when the fan is energized by electric current conducted through fan power leads 164 from electrical power means 150.

Figure 4:
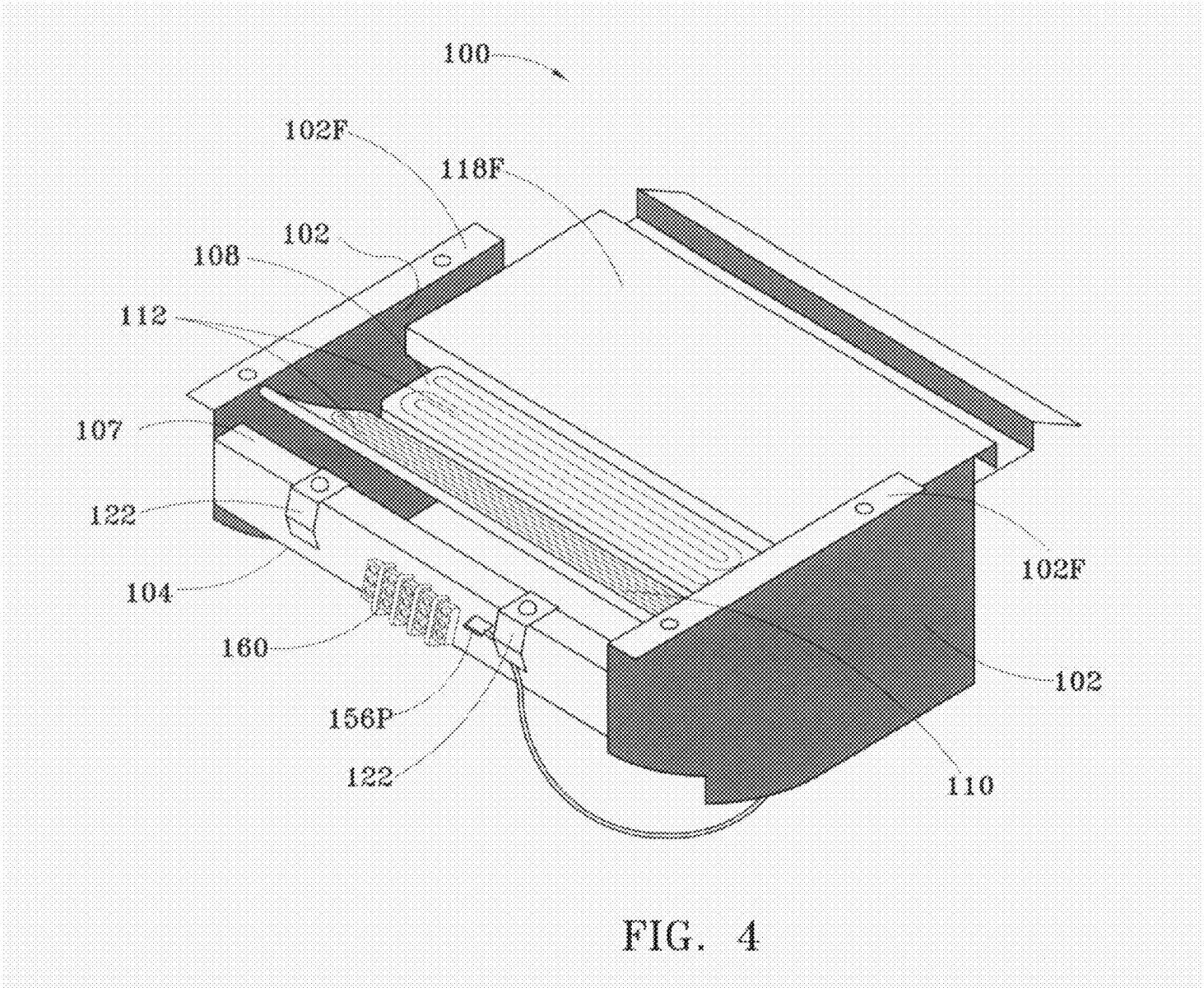
FIG. 4 is a front, perspective view of the removable heat exchanger assembly, removed from the system.
Figure 5:
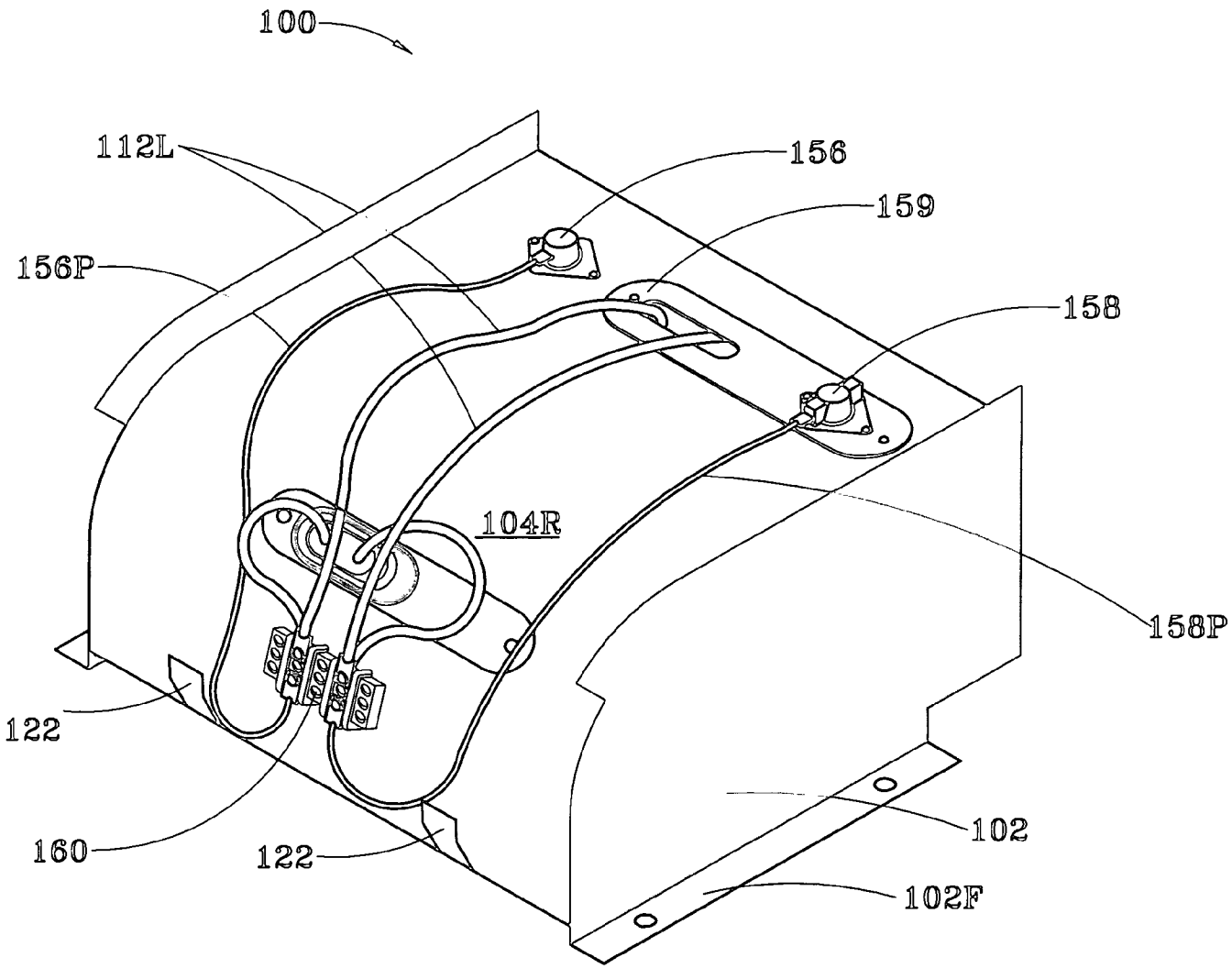
FIG. 5 is a rear perspective view thereof and showing upper and lower temperature sensors installed therein.
Figure 8:
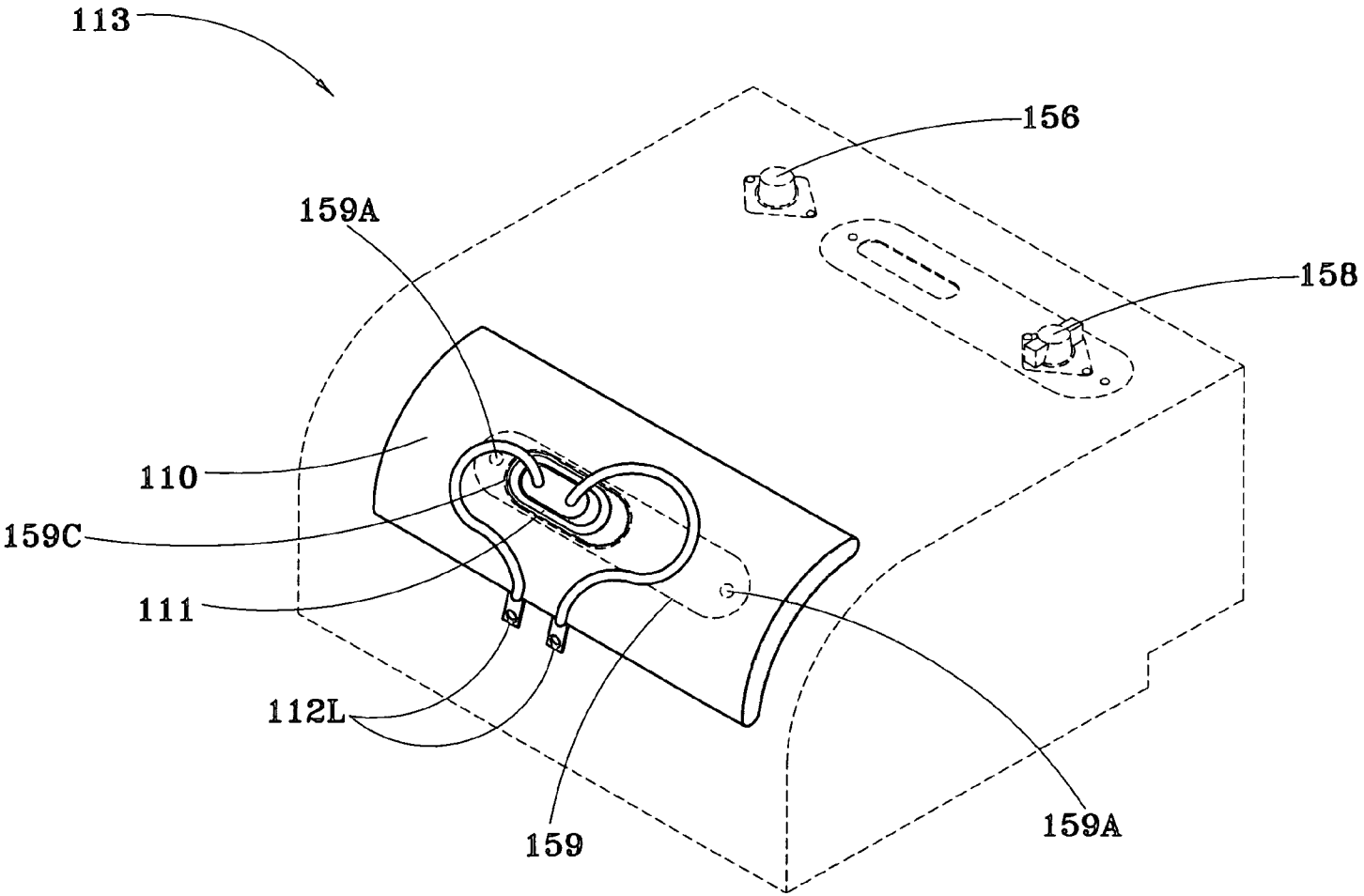
FIG. 8 is an enlarged, rear perspective view of the downstream heating element removed from the system and showing a downstream heating element cover plate in phantom view.

By removing the front panel 22 and the air outlet grate 142, the heat exchanger assembly 100 is removably insertable through the open front of the housing 12, as denoted by arrow 189 in FIG. 7, and is attachable by machine screws to the flanges 14F of the lower, front edge portions 14L of the housing sidewalls 14. Referring to FIGS. 4, 5, 7, the heat exchanger assembly 100 is seen to include a pair of laterally spaced-apart side panels 102 having front and rear edges 102F, 102R, and a rear heat exchanger panel 104 that joins the side panels 102 near the rear edges 102R thereof. A lower portion of the rear edges 102R are forwardly contoured and an upper portion of the rear edges are straight and vertical; the rear heat exchanger panel 104 has similarly contoured and flat portions to match the edges 102R. The rear heat exchanger panel 104 has a rear surface 104R and an opposite front surface 104F. A first copper plate 106 is attached to the front surface 104F of the rear heat exchanger panel 104 and is shaped and dimensioned to match and substantially cover said surface, but is spaced away from, and in front of, the rear heat exchanger panel 104, thereby providing a hollow space therebetween that is closed at upper and lower ends by upper and lower flange portions 105, 107, of the first copper plate 106, respectively. Upstream and downstream heater elements 108, 110 are attached to upper and lower front surfaces 107U, 107L of the first copper plate 106, and heater element attachment means 113 is provided for each; see FIG. 8. Each ceramic heater element 108, 110 includes a ceramic body and an electrically-resistive conductor 112 encased within the ceramic body. Preferably, the resistive conductors 112 are laid out in a sinuous path within the ceramic body. Each resistive conductor 112 has opposite ends attached to a heater element electrical wire lead 112L. The heater element leads 112L emerge from a base extension 111 on a rear surface of each of the heater elements 108, 100, which base extension protrudes through a cutout 159C in a heater element cover plate 159 that attaches to the rear surface 104R of the rear heat exchanger panel by machine screws (not shown) inserted through apertures 159A in the cover plate 159. When sufficient electrical current passes through the resistive conductors 112, they and the surrounding ceramic bodies become hot and emit infrared radiation that heats the air stream flowing past the heater elements 108, 110.

Referring to FIGS. 1, 4 and 7, the heat exchanger assembly 100 further includes a second copper plate 120 that is spaced forwardly from, and substantially parallel to, an upper portion of the first copper plate 106 within the housing 12 and adjacent to the upstream ceramic heating element 108. The assembly 100 also includes means 121 for mounting the second copper plate 120 to the assembly 100, which means is laterally disposed between, and attached to the heat exchanger side panels 102. The means 121 comprises a rear panel 118R having horizontal upper and lower flanges 118U, 118L and a coextensive, matching front channel 118F that overlies in front-to-rear spaced relation, and is received by, the rear panel 118R, thereby combining to form a hollow, closed unit. The front channel 118 F extends laterally between the side panels 102 of the heat exchanger assembly 102 and is attached thereto. The second copper plate 120 is attached to a rear surface of the rear panel 118R. The second copper plate 120 reflects back into the air transit channel 255 the infrared radiation emitted from the upper ceramic heating element 108 and that emitted from the first copper plate 106, thereby enhancing the efficiency of the system 10.

Means are provided to prevent heat from leaking out of the interior of the housing 12 into the housing 12 itself or into the means 150 for electrically powering the system 10, and thereby avoid creating a fire hazard, as well as to improve the energy efficiency of the system 10. To that end, first insulating means 114 is interposed between the side panels 102 of the heat exchanger assembly 100 and the sidewalls 14 of the housing 12 to impede flow of heat from the heat exchanger assembly side panels 102 to the housing 12. Second heat insulating means 116 is disposed to impede the flow of heat from a lower portion of the interior of the housing 12 through the isolation wall 151, which heat flow otherwise might overheat the means 150 for electrically powering the system 10. Third heat insulating means 118 is interposed between the first copper plate 106 and the rear heat exchanger panel 104. Fourth heat insulating means 202 is disposed to impede the flow of heat from the second copper plate 120 to the housing 12. Referring to FIG. 7, the first heat insulating means 114 includes a pair of oppositely-directed, insulating panels 114P having a vertically-disposed front spacer flange 114F and rear spacer flange 114R, and a horizontally-disposed top flange 114T, and further includes an insulating blanket 180 that inserts within a hollow space between said panels and the interior surfaces of the adjacent housing sidewalls 14. The isolation wall 151 has a laterally-disposed, hollow interior space, and, for a second heat insulating means 116, an insulating blanket 180 is placed within that space. For the third heat insulating means 118, an insulation blanket 180 is inserted into the hollow space between the heat exchanger assembly rear panel 104 and the first copper plate 106. The fourth heat insulating means 202 is the combination of the above-described closed, hollow unit formed by the front channel 118F and the rear panel 118R, and blanket insulation 180 inserted within the hollow space within that closed unit.

The space between the first copper plate 106 and the rear panel 20 of the housing 12 defines a first air transit channel, denoted by arrow 251; the space between the second copper plate 120 and the front panel 22 of the housing 12 defines a second air transit channel, denoted by arrow 253; and the space between the first copper plate 106 and the second copper plate 120 defines a third air transit channel, denoted by arrow 255. The relatively cool air inlet air 52, when traversing through the first and second air transit channels, 251, 253, cools the front and rear panels 20, 22 of the housing 12, and is itself warmed thereby. Heated air 53 from all three air transit channels 251, 253, 255 is combined and mixed as the heated air exits the system 10.

Figure 9:
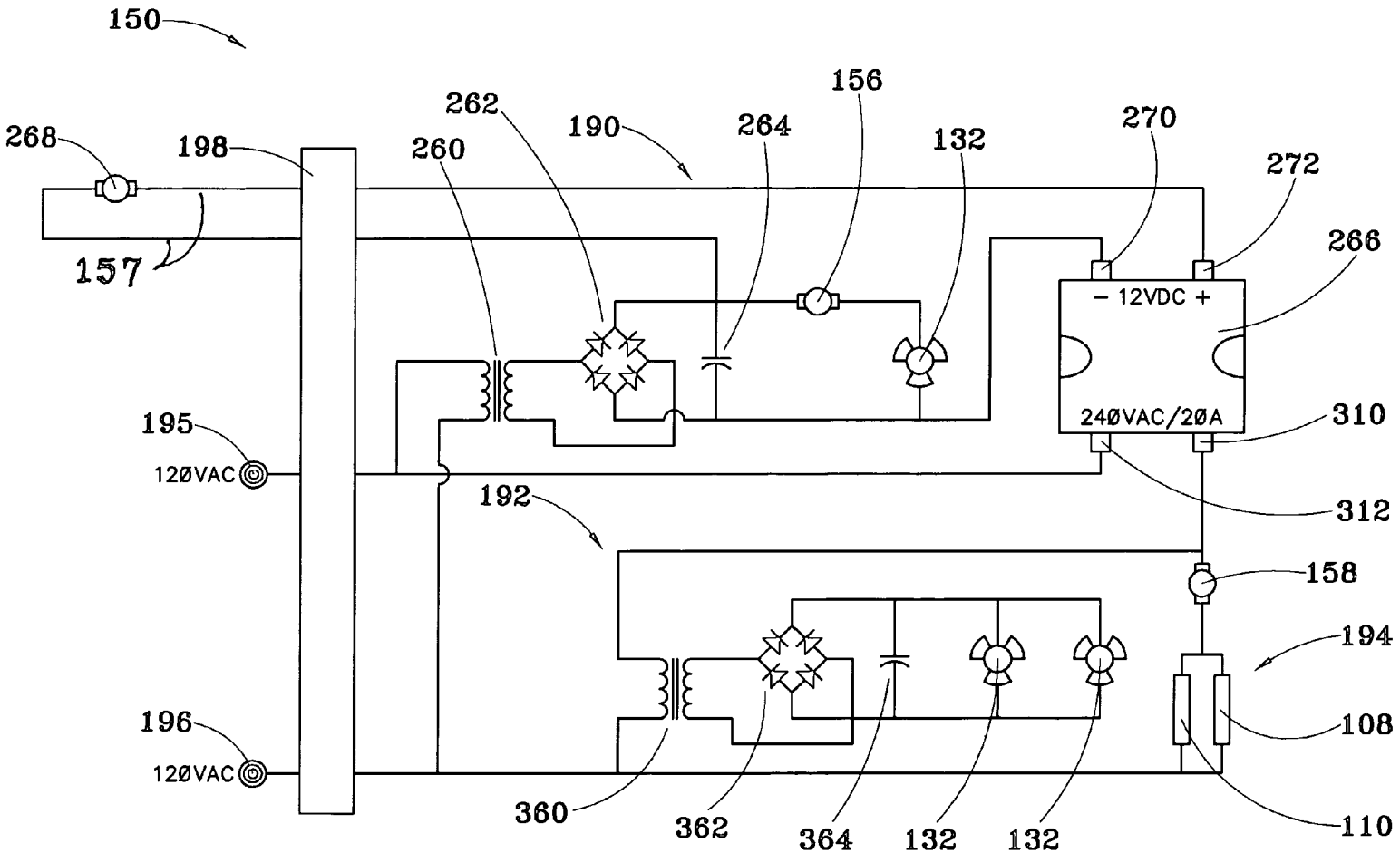
FIG. 9 is a wiring schematic for the system.
Figure 10:
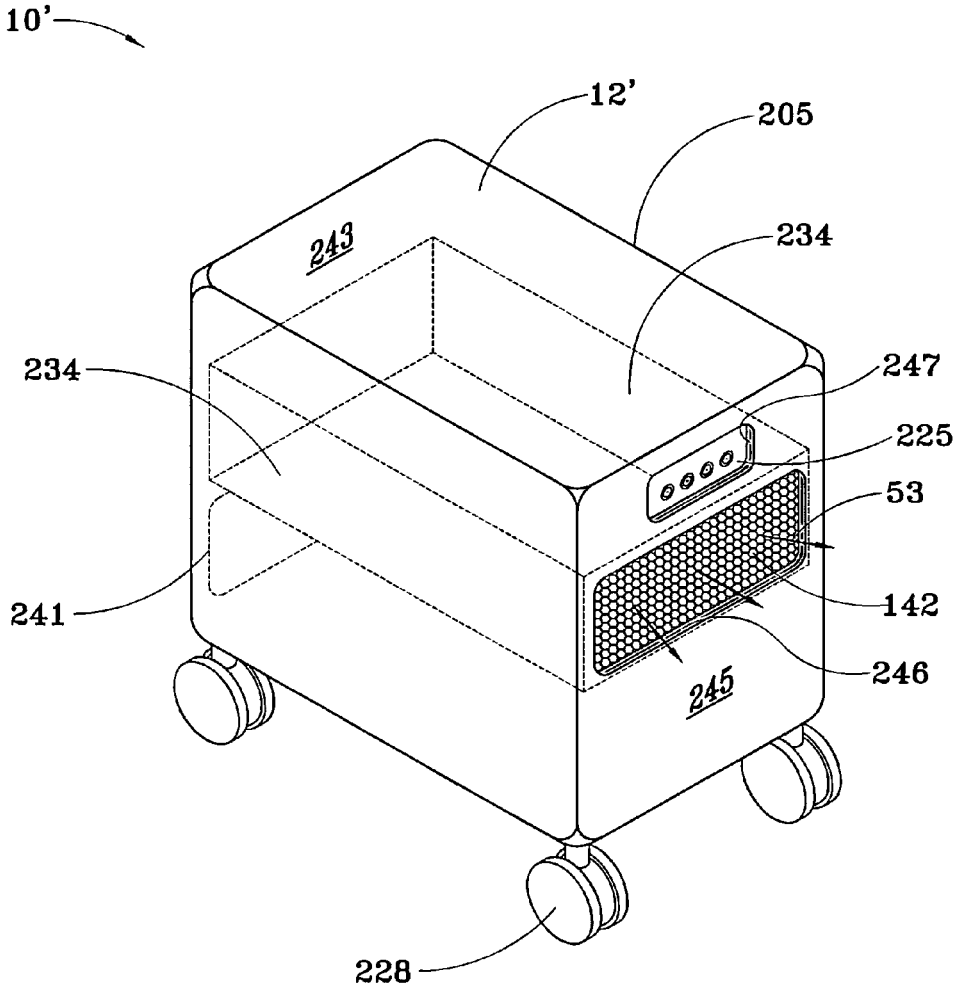
FIG. 10 is a front, perspective view of a second embodiment of the system for placement on the floor of a room.
Figure 11:
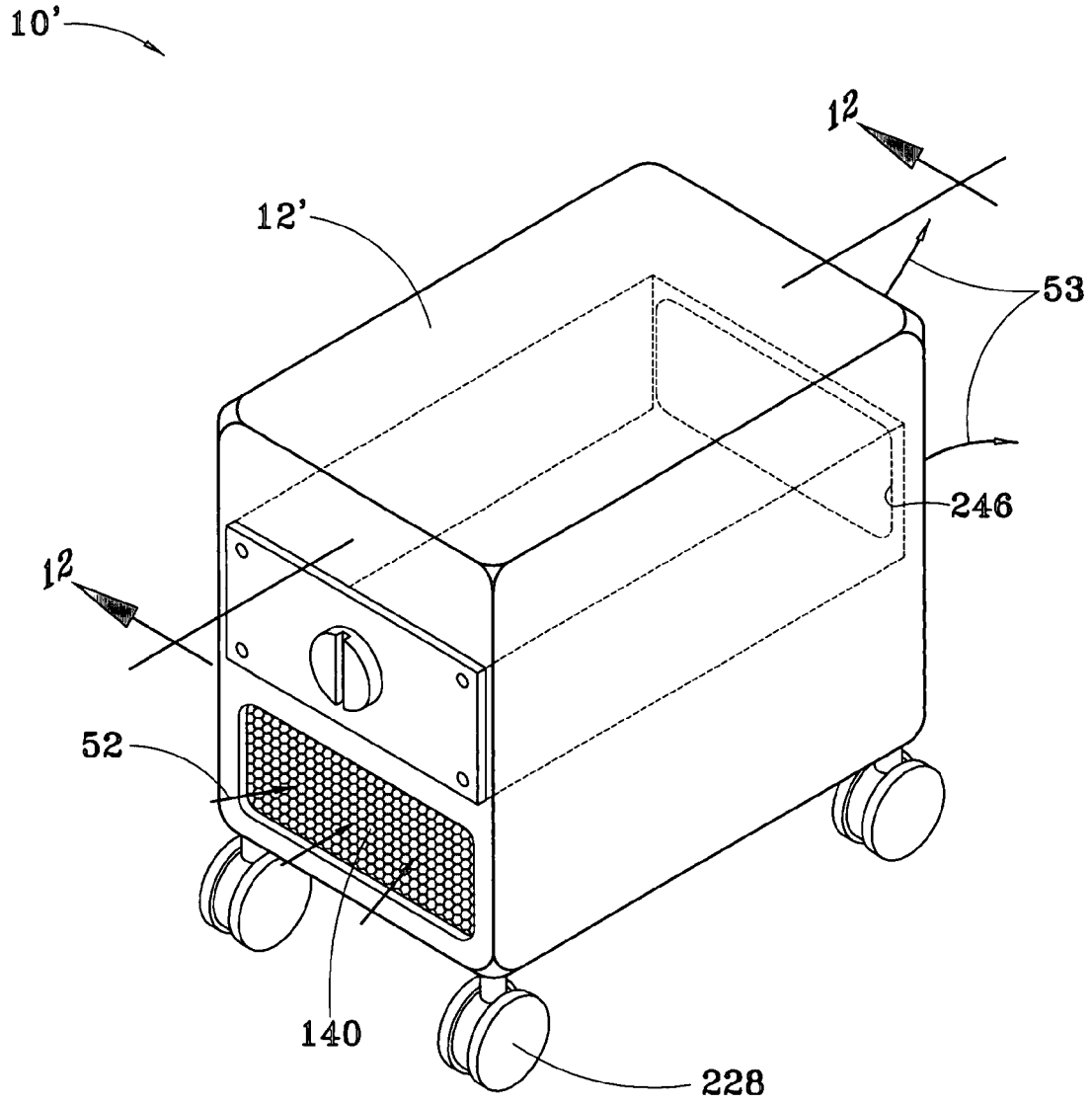
FIG. 11 is rear, perspective view thereof.
Figure 12:
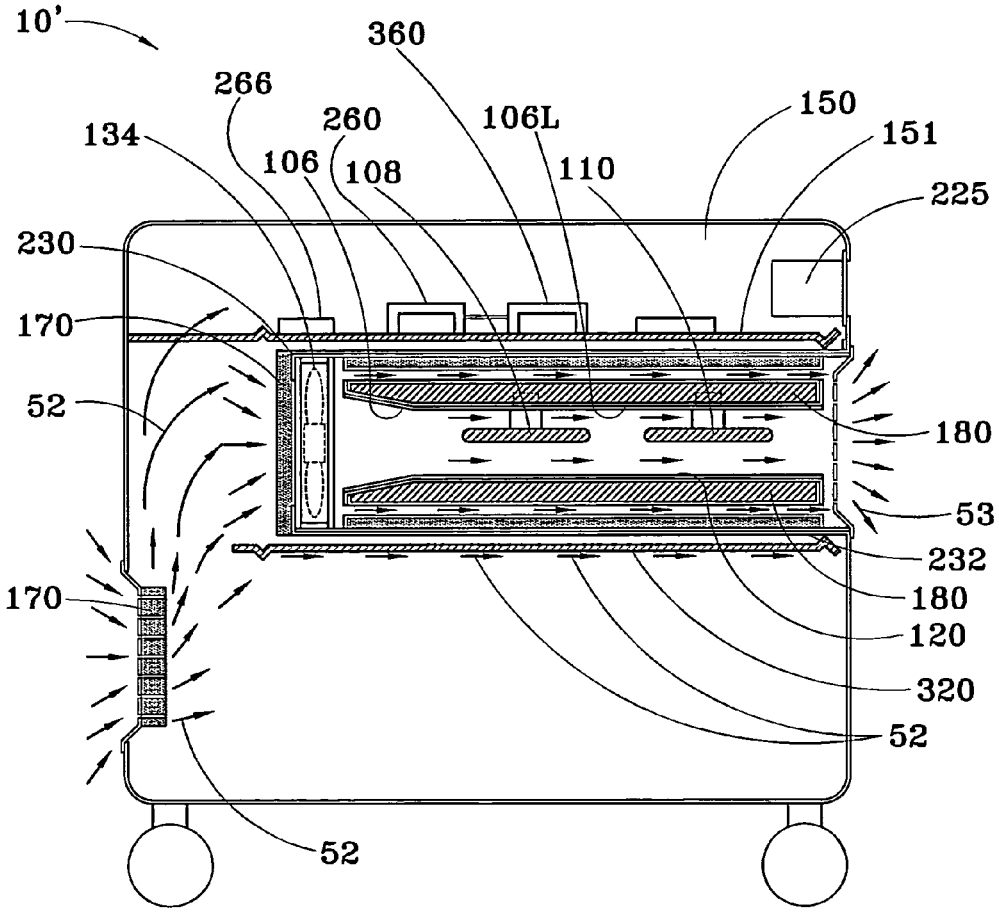
FIG. 12 is a vertical, cross-sectional view thereof taken along line 12-12 of FIG. 11.
Figure 13:
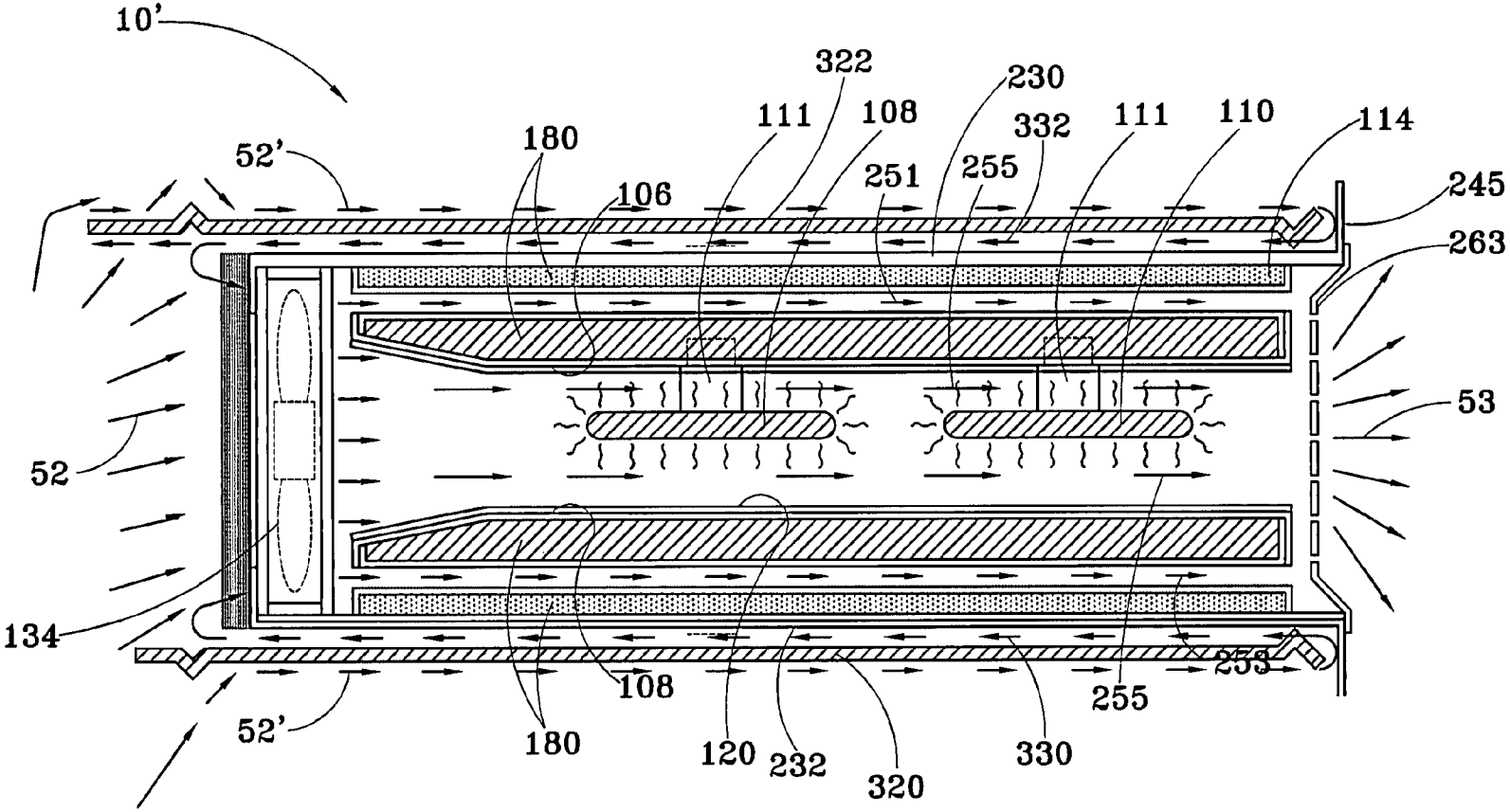
FIG. 13 is an enlarged vertical cross-section view of the heat exchanger assembly depicted in FIG. 12.

Referring to FIG. 9, means 150 for electrically powering the system 10 is depicted schematically. For most room heating purposes, the upper ceramic heating element 108 and the lower ceramic heating element 110 are each preferably rated at 400 watts, although higher or lower power ratings are within the scope of the invention. A room having an in-the-wall installation of the system 10 can be conveniently controlled by a wall-mounted thermostat 268. The means 150 includes a first direct current circuit 190, a second direct current circuit 192, and an alternating current heater element circuit 194. An alternating current power source is inputted to a pair of a.c. power inputs 195, 196 of a terminal strip 198. Referring now to the direct current circuit 190, the primary winding of a first voltage step-down transformer 260 is wired to the a.c. power inputs 195, 196. Alternating current induced in the secondary winding of the first transformer 260 is rectified by a first diode bridge rectifier 262, the d.c. pulsed output of which is smoothed by a first 1000 μF capacitor 264 wired in parallel with the diode bridge rectifier 262. Also wired by lead 56P in parallel with the first capacitor 264 is the series combination of a low temperature limit sensor switch 156 and a first fan 132. When the sensed temperature of the heat exchanger assembly is below 36° C., more or less, the switch 156 is open and the first fan is off, but when the sensed temperature exceeds about 36° C., the switch 156 is closed and the first fan operates to speed heat flow from the system 10 into the room. In order to provide d.c. current to power a solid state relay 266, such that the relay will only be energized when room temperature falls below a user selected temperature setting, a room thermostat 268 is wired in series by thermostat leads 157 with the relay d.c. power input terminals 270, 272, and relay d.c. power input terminals 270, 272 are wired in parallel with the first capacitor 264. A removeable bottom cover plate 99 mounts by machine screws to the bottom ends 14B of the sidewalls 14 to cover the means 150 for electrically powering the system 10; see FIG. 7.

Referring now to the second direct current circuit 192, the primary winding of a second step-down voltage transformer 360 is wired in series with the first a.c. input 196 and with an a.c. power output terminal 310 of the relay 266. An a.c. power input terminal 312 of the relay 266 is wired to the other a.c. power input 195. Accordingly, whenever the thermostat 268 closes due to room temperature falling below the user-selected temperature setting, the relay 266 is energized and permits a.c. current to flow through the primary winding of the second transformer 360. A second diode bridge rectifier 364 is wired to the secondary winding of the second transformer 364. A second 1000 μF capacitor 364, and second and third fans 132 are also wired in parallel with the second diode rectifier bridge 362. The upstream heater element 108 and the downstream heater element 110 are wired in parallel with each other, and their parallel combination is wired in series with a high temperature limit sensor switch 158 and in series with the first a.c. input 196 and with the output terminal 310 of the relay 266. The high temperature limit sensor switch 158 is normally closed, but opens when the temperature of the heat exchanger assembly 22, as sensed by the switch 158, exceeds 76° C. Accordingly, the second and third fans, and the heater elements 108, 100 are only energized when the relay 266 is energized—namely, when the room temperature falls below the user-selected temperature setting of the room thermostat 268. To achieve high efficiency of conversion of electrical energy to infrared radiant energy, the ceramic heating elements 108, 110 are preferably obtained from Main Key Trading Co., Ltd., Taipei, Taiwan, R.O.C., part number SL-1100400 (120 Volt, 400 watt) or SL-2200400 (220 volt, 400 watt). A pair of laterally spaced-apart, depending, resilient spacer clips 122 are attached to, and extend below, a lower flange portion 107 of the first copper plate 106 in order to engage an upper surface of the isolation wall 151 and thereby maintain a gap between the heat exchanger assembly 100 and the isolation wall; see FIG. 4.

Figure 14:
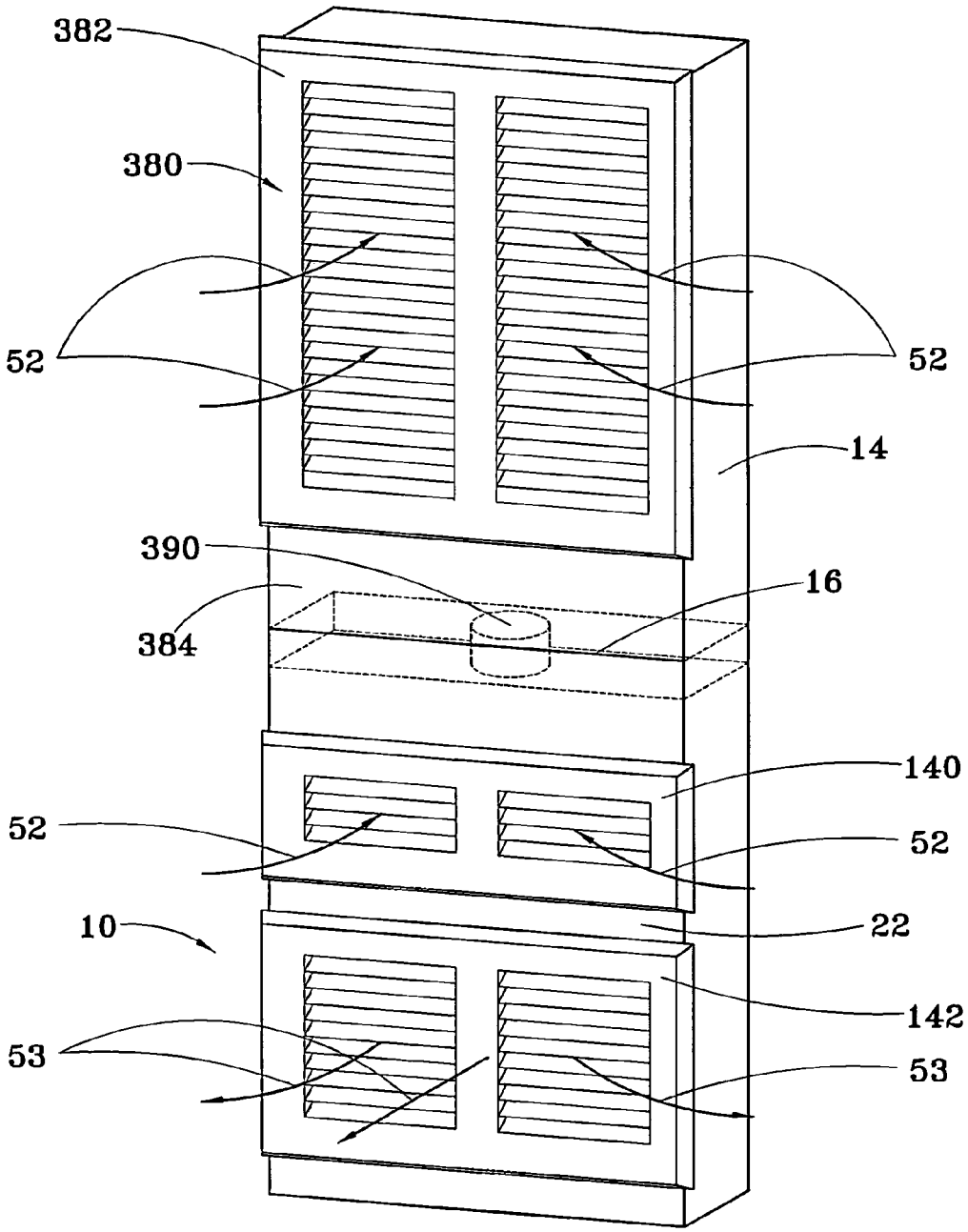
FIG. 14 is a front, perspective view of the first embodiment of the invention in combination with an attached air filtration system for combined installation within a room wall.

The first embodiment of the system 10 can be combined with an air purifier and the entire combination installed within a room wall. Referring to FIG. 14, an air purifier 380 feeds purified room air, denoted by arrows 52, to the fan assembly 130 of the first embodiment heater system 10. A hollow plenum 384 joins an upper end portion of the infrared room heater system 10 to a lower end portion of the air purifier 380 so that interior space within the air purifier communicates with interior space of the heater system 10 through an air inlet aperture 390 in the top cross member 16 (depicted in phantom outline). Room air is drawn by the fans 132 of the fan assembly 130 through air inlet grate 382 of the purifier 380, passes through means for air filtration and purification in the purifier (not shown), through the air inlet opening 390, through the fan assembly 130, is heated within the heat exchanger assembly 100, and expelled through the air outlet grate 142 back into the room as heated, purified air, denoted by arrows 53. In the event that the purifier air inlet grate 382 becomes clogged so that the purifier 380 becomes inoperable, room air 52 can continue to enter the heater portion 10 of the combination through the air inlet grate 140 of the heater system, and the heater system 10 can continue to heat the room. In such a combination, the electrostatic mesh filter 170 is preferably disposed within the air purifier 380 itself instead of within the heater system 10. To fit within a standard wall, the air purifier 380, like the heater system 10, must have depth not exceeding 3½ inches (8.9 cm), nor width exceeding the space between 16 inch (40.6 cm) on center wall studs.

In a second, alternative embodiment suitable for placement on the floor of a room, as depicted in FIGS. 10-13, the system 10' is housed in a housing 12' that encloses a closed space except for an air inlet cutout 241 on a rear wall 243 thereof, and an air outlet cutout 244, a control panel cutout 247, and a heat exchanger assembly cutout 246 on a front wall 245 thereof. An a.c. power cord and plug (not shown) are attached to the electric power supply means 150 of the system 10' for insertion into a wall a.c. plug outlet. For portability, the housing 12' preferably is equipped with caster wheels 228. Room air 52 is drawn into the system 12' through an air inlet grate 140 mounted exteriorly over the air inlet cutout 241 by one or more fans mounted in a fan assembly bracket 134. The air 52 passes through an electrostatic replacement mesh filter 170 mounted interiorly over the air inlet cutout 241, and from there is heated by infrared radiation as it flows through a horizontally disposed heat exchanger assembly 100', thence to exit through the heat exchanger cutout 246. The heat exchanger assembly 100' includes vertically spaced-apart upper and lower panels 230, 232 joined by laterally spaced-apart sidewalls 234, as depicted in phantom outline in FIG. 10. With the air outlet grate 263 removed, the heat exchanger assembly 100' can be slid into and out of the housing 12' between horizontal, vertically spaced-apart lower and upper tracks 320, 322. The tracks 320, 322 extend from near the front wall 245 rearward toward the rear wall 243 within the interior space of the housing 12'. When the heat exchanger assembly is installed within the housing 12', the tracks 320, 322 are vertically spaced apart sufficiently from the lower and upper panels 232, 230, respectively, to permit a portion of the inlet air, denoted by arrows 52', to flow rearward through a fourth air transit channel, denoted by arrows 330 and defined by the space between the lower panel 232 and the lower track 320, and through a fifth air transit channel, denoted by arrows 332, and defined by the space between the upper panel 230 and the upper track 322, thereby cooling the upper and lower tracks. Since the upper and lower tracks 320, 322 are attached to the housing 12, air flow through the fourth and fifth air transit channels likewise helps to cool the housing as well as the means 150 for electrically powering the system that is mounted within the housing above the upper track 322. The air 52' then joins the rest of the inlet air 52 by transiting through the fan assembly 130 and thence through the heat exchanger assembly 100'. First heat insulating means 114, substantially identical to that described above for the first embodiment 10, is attached to a lower surface of the upper panel 230 and attached to an upper surface of the lower panel 232. A first copper plate 106 is mounted to the heat exchanger assembly 100' adjacent to the first insulating means 114 of the upper panel 230, but vertically spaced away therefrom to define a first air transit channel, denoted by arrows 251. A second copper plate 120 is mounted to the heat exchanger assembly 100' adjacent to the first insulating means 114 of the lower panel 232, but vertically spaced away therefrom to define a second air transit channel, denoted by arrows 253. The heat exchanger assembly 100' further includes an upstream ceramic heater element 108 and a downstream ceramic heater element 110, and means for mounting each of these heating elements to a lower surface 106 L of the first copper plate 106. The heater elements 108, 110 in the second embodiment are preferably rated at 750 watts each. The space between the first copper plate 106 and the second copper plate 120 defines a third air transit channel, denoted by arrows 255. Inlet air 52 is heated by passage through all three air transit channels 251, 253, 255, and especially by passage through the third transit channel 255. As in the case of the first embodiment 100, the relatively cool inlet air 52, when traversing through the first and second air transit channels 251, 253, cools the upper and lower panels 230, 232 of the housing 12', respectively, and consequently is itself warmed thereby. Heated air 53 from all three air transit channels 251, 253, 255 is combined and mixed as it exits the system 100' through an air outlet grate 263 mounted over the air outlet cutout 246 at the front of the system 100'. A recessed control box 225 is mounted on the front of the housing 12', which contains control electronics for the system 10' and includes manual thermostat setting controls 268. Preferably, the control box 225 includes an LED display (not shown) to indicate that the system 10' is turned on, that the fans 132 are operating, etc. The thermostat 268 includes a probe (not shown) that is disposed within the incoming air stream 52 adjacent to the air inlet cutout 241. Other components of the second embodiment 100' are identical or substantially identical to those of the first embodiment 10, including the heater elements 108, 110, and the means for electrically powering the system 10', which means incorporates the circuit components and wiring depicted in FIG. 9.

From the foregoing description, it will be clear that the present invention may be embodied in other specific forms without departing from the spirit or essential characteristics thereof. For instance, although the first embodiment of the system 10 is depicted in FIGS. 1-7 with the air inlet grate 140 above, and the air outlet grate 142 below, the heat exchanger assembly 22, the entire system 10 could be inverted so that the air inlet grate is disposed below, and the air outlet grate is disposed above, the heat exchanger assembly 22; and, so inverted, the system 10 remains the same invention. The copper plates 106, 120 are preferably made of high purity copper, but may be made of copper alloys that are at least 85 percent by weight copper; accordingly, the term "copper" herein shall be understood to include such copper alloys. Except for the electrical components, copper plates, fans, ceramic heater elements, and caster wheels, the system is preferably fabricated from sheets of galvanized steel or steel having other steel preparation coating. We chose 120 volt to 12 volt step down transformers 260, 360 and, for quiet operation, 12 volt d.c. fans are preferred, e.g., Noctua model NF0R8 80 mm fans, with rotational speed 1800 RPM and acoustical noise level 17 dBA, available from Rascom Computer distribution Ges.m.b.H., Vienna, Austria. We prefer an electrostatic filter 170 manufactured by Sparks Technology, Inc. of Batavia, Illinois, using an electrostatic material sold by Permatron, Inc. under the trademark Permatron, in combination with a carbon, gas absorption membrane. The blanket insulation 180 is preferably half-inch (1.27 cm) thick ceramic fiber blanket. Thus, the presently disclosed embodiments are therefore to be considered in all respects as illustrative and not restrictive, the scope of the invention being indicated by the appended claims, and not limited to the foregoing description.

We claim:

1. An electrically-powered, infrared room air heater system installable within a wall of a building, comprising:

a housing, said housing having a pair of laterally spaced-apart sidewalls that each extend vertically from a bottom end to a top end, laterally disposed bottom and top cross members that join said bottom and top ends, respectively, and a laterally disposed power supply isolation wall that joins said sidewalls intermediate the bottom and top cross members, said sidewalls, laterally disposed power supply isolation wall, and top and bottom cross members having rear edges and opposite front edges, a housing rear panel to which the rear edges of the side walls, laterally disposed isolation wall and bottom and top cross members are attached, and a front panel mountable to a midportion of the front edges of the sidewalls intermediate the bottom and top ends thereof, thereby defining an interior space of the housing, said interior space having an upper open front and a lower open front above and below said front panel, respectively;

a heat exchanger assembly removably insertable through the lower open front into said interior space and attachable to a lower portion of said housing, said assembly including a pair of laterally spaced-apart side panels having rear edges and opposite front edges;

a rear heat exchanger panel that joins said side panels near the rear edges thereof, said panel having a rear surface and an opposite front surface;

a first copper plate attached to the front surface of the rear heat exchanger panel and substantially covering the front surface thereof in front-to-rear spaced relation;

one or more ceramic heater elements, each element including a ceramic body and an electrically-resistive conductor encased within said ceramic body, said conductor having opposite ends and each said end being attached to a heater element electrical wire lead, said element emitting infrared radiation whenever sufficient electric current passes through said conductor;

a second copper plate spaced forwardly from and substantially parallel to the first copper plate such that air can flow between the first and second copper plates;

means for mounting the second copper plate to the heat exchanger assembly; and means for mounting each ceramic heater element to a front surface of the first copper plate;

first heat insulating means interposed between the side panels of the heat exchanger assembly and the sidewalls of the housing;

second heat insulating means disposed to impede the flow of heat through the isolation wall;

third heat insulating means interposed between the first copper plate and the rear heat exchanger panel;

fourth heat insulating means disposed to impede the flow of heat from the second copper plate to the housing;

a fan assembly attached to the housing, said assembly including at least one electric fan, said assembly being disposed to draw room air into the interior space of the housing and thence to force the air toward and through the heat exchanger assembly and thence back out into the room;

and means for electrically powering the system when room temperature falls below a user-selected room temperature setting, said means disposed within an interior space of the housing between the bottom cross member and the laterally disposed isolation wall.

2. The system of claim 1, wherein the one or more ceramic heater elements comprise an upstream ceramic heater element and a downstream ceramic heater element.

3. The system of claim 2, further comprising an air inlet grate mountable to the front edges of the sidewalls of an upper portion of the housing and adapted to permit room air to be drawn therethrough into the interior space of the housing.

4. The system of claim 3, further comprising an air outlet grate mountable to the front edges of the sidewalls of a lower portion of the housing.

5. The system of claim 4, wherein the resistive conductor of each heating element is sinuously encased within ceramic, and the ceramic encasement has a front-to-rear thickness less than or equal to 0.5 inch (1.27 cm).

6. The system of claim 5, wherein the system has an upstream heater element attached to a front surface of an upper portion of the first copper plate and a downstream heater element attached to a front surface of a lower portion of the first copper plate.

7. The system of claim 6, wherein the first heat insulating means includes a pair of oppositely-directed, insulating panels having front, rear and top spacer flanges, one of each panel being attached to a lower, interior surface of a sidewall of the housing; and insulation blankets inserted between said panels and said interior surfaces of the sidewalls of the housing.

8. The system of claim 7, wherein the laterally disposed isolation wall has a hollow interior space and the second heat insulation means includes an insulation blanket within said interior space.

9. The system of claim 8, wherein the third heat insulating means interposed between the first copper plate and the rear heat exchanger panel includes an insulation blanket.

10. The system of claim 9, wherein the means for mounting the second copper plate to the heat exchanger assembly includes a closed, hollow unit comprised of a channel and a coextensive, matching rear panel, said channel extending laterally between the side panels of the heat exchanger assembly and attached thereto, said second copper plate being attached the rear panel of said unit, and the fourth heat insulating means includes blanket insulation disposed within said unit.

11. The system of claim 10, wherein the width and depth of the housing are adapted for installation into a standard wall of a room having wall studs spaced 16 inches (40.6 cm) on center apart and depth 3½ inches (8.9 cm).

12. The system of claim 11, wherein the means for electrically powering the system includes a thermostat for sensing room temperature, said thermostat providing a closed circuit through the thermostat when room temperature is below a user-selected room temperature setting and an open circuit when room temperature exceeds said setting;

a solid state relay, said relay having direct current input terminals for connection to a first direct current source in order to energize the relay and having alternating current output terminals for connection to an alternating current power source such that the relay, when energized, provides a conductive path for said alternating current power source;

a high temperature limit sensor switch attached to the heat exchanger assembly; said switch being closed when the sensed temperature of the heat exchanger assembly is below a predetermined high temperature limit and open when said temperature exceeds said limit;

a low temperature limit sensor switch attached to the heat exchanger assembly, said switch being open when the sensed temperature of the heat exchanger assembly is below a predetermined temperature limit and closed when said temperature exceeds said limit;

a first direct current circuit for receiving, and converting to a first rectified, direct current, the alternating current inputted to said means, and feeding said first rectified, direct current through said thermostat to the direct current input terminals of the relay;

a second direct current circuit for receiving, and converting to a second rectified, direct current, the alternating current inputted to said means, and for feeding said second rectified, direct current through at least one fan within the fan assembly, said second direct current circuit being wired in parallel to the alternating current output terminals of said relay and thereby electrically energized only when the relay is energized; and an alternating current circuit wired in series with the alternating current output terminals of the relay, in series with the high temperature limit sensor switch, and in series with the resistive conductors of the upstream and downstream ceramic heater elements.

13. The system of claim 12, further comprising an electrostatic replacement mesh filter interposed between the air inlet grate and the fan assembly.

14. The system of claim 12, wherein the top cross member has an air inlet opening, and further comprising:

an air purifier, said air purifier dimensioned to fit within a standard room wall having depth 3½ inches (8.9 cm) and 16 inch (40.6 cm) or more on center wall studs, said air purifier including a second air inlet grate through which room air can enter into interior space of the air purifier;

and means for air filtration and purification within said interior space; and a plenum that joins an upper end portion of the system to a lower end portion of the air purifier, such that the interior space of the purifier communicates with the interior space of the system;

whereby, the fans, when energized, draw room air through the second inlet grate into the interior space of the air purifier, through the means for air filtration and purification, through the air inlet opening, and forces said air through the heat exchanger assembly and back out into the room as heated, purified air.

15. The system of claim 14, wherein the low temperature limit is in the range 22° C. to 50° C. and the high temperature limit is in the range 76° C. to 106° C.

16. The system of any of claims 1-15, wherein the infrared radiation has a wavelength in the range 5-14 micron.

17. An electrically-powered, infrared room air heater for heating the air of a room, comprising:

a substantially closed housing that defines an interior space, said housing having an air inlet cutout to permit room air to enter the housing, an air outlet cutout to permit air within the interior space to exit the housing and return to the room, a heat exchanger access cutout, and horizontal, vertically spaced-apart upper and lower tracks;

a heat exchanger assembly insertable into, and removable from, the interior space of the housing through the heat exchanger access cutout and between the upper and lower tracks and in vertically spaced relation to said tracks, said assembly including vertically spaced-apart upper and lower panels joined by laterally spaced apart sidewalls;

first heat insulating means attached to a lower surface of the upper panel and attached to an upper surface of the lower panel;

a first copper plate mounted to the assembly adjacent to the first insulating means of the upper panel, but vertically spaced away therefrom;

a second copper plate mounted to the assembly adjacent to the heat insulating means of the lower panel, but vertically spaced away therefrom;

one or more ceramic heater elements, each element including a ceramic body and an electrically-resistive conductor encased within said ceramic body, said conductor having opposite ends and each said end being attached to a heater element electrical wire lead, said element emitting infrared radiation whenever sufficient electric current passes through said conductor; and means for attaching each heater element to a lower surface of the copper plate;

a fan assembly attached to the housing, said assembly including at least one electric fan, said assembly disposed to draw room air into an upper portion of the interior space of the housing and thence to force the air toward, through and around the heat exchanger assembly and back out into the room; and means for electrically powering the system when room temperature falls below a user-selected room temperature setting, said means being disposed above the upper track;

means to thermally insulate the means for electrically powering the system from heat generated by the heat exchanger assembly, said means including means to direct a flow of air, prior to the passage of said air through the heat exchanger assembly, through a fourth air transit channel defined by the space between the lower track and the lower panel and through a fifth air transit channel defined by the space between the upper panel and the upper track.

18. The system of claim 17, wherein the one or more ceramic heater elements comprise an upstream ceramic heater element and a downstream ceramic heater element.

19. The system of claim 18, wherein the means for electrically powering the system includes a thermostat for sensing room temperature, said thermostat providing a closed, electrically conductive path through the thermostat when room temperature is below a user-selectable room temperature setting and an open, electrically nonconductive path when room temperature exceeds said setting;

a solid state relay, said relay having direct current input terminals for connection to a first direct current source in order to energize the relay and having alternating current output terminals for connection to an alternating current power source, such that the relay, when energized, provides a conductive path for said alternating current power source;

a high temperature limit sensor switch attached to the heat exchanger assembly, said switch being closed when the sensed temperature of the heat exchanger assembly is below a predetermined high temperature limit and open when said temperature exceeds said limit;

a low temperature limit sensor switch attached to the heat exchanger assembly, said switch being open when the sensed temperature of the heat exchanger assembly is below a predetermined a predetermined low temperature limit and closed when said temperature exceeds said limit;

a first direct current circuit for receiving, and converting to a first rectified, direct current, the alternating current inputted to said means, feeding said first rectified, direct current through said thermostat to the direct current input terminals of the relay, and feeding said first rectified direct current through the low temperature limit sensor switch and through at least one fan of the fan assembly wired in series with the low temperature limit sensor switch;

a second direct current circuit for receiving, and converting to a second rectified, direct current, the alternating current inputted to said means, and for feeding said second rectified, direct current through at least one fan within the fan assembly, said second direct current circuit being wired in parallel to the alternating current output terminals of said relay and thereby electrically energized only when the relay is energized; and an alternating current circuit wired in series with the alternating current output terminals of the relay and in series with the high temperature limit sensor switch, and further in series with the resistive conductors of the upstream and downstream ceramic heater elements.

20. The system of claim 19, further comprising an air inlet grate mountable over the air inlet cutout of the housing.

21. The system of claim 20, further comprising an air outlet grate mountable over the air outlet cutout of the housing.

22. The system of claim 21, further comprising an electrostatic mesh filter interposed between the air inlet grate and the fan assembly.

23. The system of claim 22, wherein the resistive conductor of each heating element is sinuously encased within ceramic, and the ceramic encasement has a front-to-rear thickness less than or equal to 0.5 inch (1.27 cm).

24. The system of claim 23, further comprising caster wheels attached to the housing to facilitate movement of the system across a room floor surface.

25. The system of any of claims 17-24, wherein the infrared radiation emitted within the heat exchanger assembly has a wavelength in the range 5-14 micron.

26. A method for heating the air of a room, comprising the steps of:

(a) drawing room air into a substantially closed interior space of a heater system that includes a housing, wherein said housing has first and second, spaced-apart sidewalls and contains means for electrically powering the system and a heat exchanger assembly that emits infrared radiation whenever sufficient electric current from the means for electrically powering the system passes through a resistive conductor encased within one or more ceramic heating elements attached to a first copper plate;

(b) thence forcing the air within said interior space through parallel first, second, and third air transit channels, wherein (1) the first copper plate, mounted to the heat exchanger assembly, is disposed adjacent to, but spaced apart from, a first heat insulating means attached to a horizontal, upper panel of said assembly, and the first air transit channel is disposed between the first copper plate and said first insulating means;

(2) a second copper plate, mounted to the heat exchanger assembly, is disposed opposite said ceramic heating elements and adjacent to, but spaced apart from, a first heat insulating means attached to a horizontal lower panel of the heat exchanger, and the second air transit channel is disposed between the second copper plate and said first insulating means; and (3) the third air transit channel is defined by the space between the first and second copper plates; and (c) thence forcing the air that has passed through the first, second and third air transit channels back out into the room;

whereby the air that flows through the first and second air transit channels cools the housing, the air that flows through all three air transit channels is heated by infrared radiation, and the air that is forced back out into, the room heats the room.

27. The method of claim 26, wherein the system has at least one fan powered by the means for electrically powering the system that draws room air into the interior of the housing, and forces the air to flow through the first, second and third air transit channels and back out into the room.

28. The method of claim 27, wherein the one or more ceramic heating elements comprise an upstream ceramic heating element and a downstream ceramic heating element.

29. The method of claim 28, wherein the housing has an air inlet cutout and an air inlet grate mounted over the air inlet cutout, and further comprising, prior to step (a), the step of drawing the room air through said grate.

30. The method of claim 29, wherein the housing has an air outlet cutout and air outlet grate mounted over the air outlet cutout, and in step (c) the air passes through the air outlet grate on its way back out into the room.

31. The method of claim 30, wherein an electrostatic replacement mesh filter is interposed between the air inlet grate and the fan assembly.

32. The method of claim 31, wherein the resistive conductor of each heating element is sinuously encased within ceramic, and the ceramic encasement has a front-to-rear thickness less than or equal to 0.5 inch (1.27 cm).

33. The system of any of claims 32, wherein the infrared radiation emitted within the heat exchanger assembly has a wavelength in the range 5-14 micron.

* * * * *